US007981465B2

(12) United States Patent
Burch

(10) Patent No.: US 7,981,465 B2
(45) Date of Patent: Jul. 19, 2011

(54) METHOD AND APPARATUS FOR POWDER COATING STATOR STACKS

(75) Inventor: Jerry C. Burch, Waynesville, OH (US)

(73) Assignee: Globe Motors, Inc., Dayton, OH (US)

( * ) Notice: Subject to any disclaimer, the term of this patent is extended or adjusted under 35 U.S.C. 154(b) by 804 days.

(21) Appl. No.: 12/009,029

(22) Filed: Jan. 16, 2008

(65) Prior Publication Data

US 2008/0171135 A1 Jul. 17, 2008

Related U.S. Application Data

(60) Provisional application No. 60/885,042, filed on Jan. 16, 2007.

(51) Int. Cl.
*B05D 1/12* (2006.01)

(52) U.S. Cl. ..... 427/104; 427/8; 427/195; 427/295

(58) Field of Classification Search ..... 427/8, 104, 427/195, 295

See application file for complete search history.

(56) References Cited

U.S. PATENT DOCUMENTS

| | | | |
|---|---|---|---|
| 3,660,136 | A | 5/1972 | Guilbault et al. |
| 3,806,039 | A | 4/1974 | Mocarski |
| 3,889,015 | A | 6/1975 | English |
| 3,901,185 | A | 8/1975 | Goodridge et al. |
| 4,606,928 | A | 8/1986 | Dunford et al. |
| 4,808,432 | A | 2/1989 | Hajek |
| 4,950,497 | A | 8/1990 | Gillette et al. |
| 4,987,001 | A | 1/1991 | Knobbe et al. |
| 5,041,301 | A | 8/1991 | Gillette et al. |
| 5,052,332 | A | 10/1991 | Hajek et al. |
| 5,116,636 | A | 5/1992 | Hajek et al. |
| 5,173,325 | A | 12/1992 | Knobbe et al. |
| 5,190,790 | A | 3/1993 | Blankemeyer |
| 5,213,847 | A | 5/1993 | Hajek |
| 5,242,718 | A | 9/1993 | Gillette et al. |
| 5,402,938 | A | 4/1995 | Sweeney |
| 5,540,776 | A | 7/1996 | Habsburg-Lothringen |
| 5,964,429 | A | 10/1999 | Burch et al. |
| 6,126,748 | A | 10/2000 | DeHart |
| 6,129,952 | A | 10/2000 | DeHart |
| 6,280,798 | B1 | 8/2001 | Ring et al. |
| 6,322,629 | B1 | 11/2001 | Okada et al. |
| 6,458,210 | B1 | 10/2002 | Bellemare et al. |
| 6,520,011 | B2 | 2/2003 | Nakamura |
| 6,558,752 | B2 | 5/2003 | Bellemare et al. |
| 6,620,243 | B1 | 9/2003 | Bertellotti et al. |

(Continued)

OTHER PUBLICATIONS

Donaldson Torit TD Dust Collectors, Models TD-162, TD-486, and TD-573, Data Sheet TD Jun. 2005, Donaldson Co., Minneapolis, MN.

*Primary Examiner* — Frederick J Parker
(74) *Attorney, Agent, or Firm* — Stevens & Showalter LLP

(57) ABSTRACT

A method and apparatus for applying a solid particulate powder coating to a stator stack having a plurality of longitudinally extending stator slots. The apparatus includes a coating application station for applying powder particles to the stator stack, a coating removal station for displacing the powder particles from selected areas of the stator stack and a curing oven for curing the powder particles onto the stator stack. A collection hopper is provided for receiving recycled powder particles and includes a porous structural side wall for permitting air to exit the hopper while retaining the powder particles from passing into the environment around the system.

18 Claims, 11 Drawing Sheets

U.S. PATENT DOCUMENTS 6,759,086 B2 * 7/2004 Dimaio et al. ..... 427/195
6,827,780 B2 12/2004 Bertellotti
2002/0130582 A1 9/2002 Oketani et al.
2004/0219301 A1 11/2004 Bertellotti et al.
2005/0037151 A1 2/2005 Bertellotti
2005/0057104 A1 * 3/2005 Tamura et al. ..... 310/45

* cited by examiner

METHOD AND APPARATUS FOR POWDER COATING STATOR STACKS

CROSS-REFERENCE TO RELATED APPLICATION

This application claims the benefit of U.S. Provisional Application No. 60/885,042, filed Jan. 16, 2007, which is incorporated herein by reference.

FIELD OF THE INVENTION

The present invention generally relates to powder coating of components and, more particularly, the invention relates to providing a powder coating to selected surfaces of dynamo-electric machine stator stacks.

BACKGROUND OF THE INVENTION

In a powder coating system, a powder, such as a resinous polymer in the form of powder particles, is initially adhered to the exposed surface of an article to form a powder coating on the article. This initial coating process typically involves electrically grounding the article being coated and electrostatically charging the powder particles such that an electrostatic attraction causes the powder to adhere to the article in a substantially uniform thickness. The coated article is then cured using heat to fully adhere the coating to the article.

In one known technique for adhering powder particles to articles, a fluidized bed of electrostatically charged powder particles is formed for supplying the powder particles to the articles. A layer of the powder particles is aerated by means of ionized air passing upwardly through a porous surface, i.e., a porous plate or a screen, supporting the powder particles. The particles generally all carry the same charge and repel each other to form a cloud of substantially uniformly distributed charged particles. Grounded articles located in the area of the cloud of charged particles attract the charged particles to form a coating on the grounded articles. The particles are generally more attracted to areas that are uncoated than those areas that already have a coating, such that a generally uniform coating of the particles is formed on the exposed surfaces of the article.

Typically, it is desirable to coat certain portions of an article surface while leaving remaining surfaces on the article uncoated prior to the curing step of the process. Further, when coating surfaces on the interior of an article, it is advantageous to provide a certain flow of particles onto the article to ensure that a sufficient density of particles will pass into contact with all surfaces to be coated. For example, a stator stack for a dynamo-electric machine requires that a coating be provided to slot portions and end surfaces of the stator stack that contact stator windings, while leaving remaining surfaces uncoated The stator slots comprise elongated passages of relatively small cross section which may not receive sufficient flow from the aerated cloud of particles to form a coating of the desired uniformity. An example of a stator stack that may receive a coating is illustrated in U.S. Pat. No. 5,964,429, which patent is incorporated herein by reference.

An additional aspect associated with powder coating comprises containing the powder to limit dispersal of the powder to the surrounding environment. In particular, the powder comprises very fine particulate material that has typically required operations to be performed in chambers or enclosures in order to ensure containment of the powder. However, known production configurations incorporating enclosures present a limitation to effective production processes, including those incorporating automated processing of articles.

Accordingly, there is a need for a method and/or system for coating stator stacks with a powder coating that provides a uniform thickness, and that may be performed in a consistent and efficient manner. There is a further need for a method and/or system to efficiently process stator stacks with a coating material, where portions of the stator stacks may be coated and remaining portions are without the coating material.

SUMMARY OF THE INVENTION

In accordance with one aspect of the invention, a method is provided for applying a solid particulate powder coating to a stator stack having a plurality of longitudinally extending stator slots. The method comprises the steps of: depositing particulate powder coating material on the stator stack; positioning the stator stack over a mandrel; rotating the mandrel and stator stack while displacing the coating material from an outer circumferential surface of the stator stack; and holding the stator stack while rotating the mandrel relative to the stator stack to displace the coating material from an inner circumferential surface of the stator stack.

In accordance with another aspect of the invention, a system is provided for applying a solid particulate powder coating to a stator stack having a plurality of longitudinally extending stator slots. The apparatus comprises a powder coating station for depositing particulate powder coating material on a stator stack, and a coating material removal station for displacing excess coating material from the stator stack. The coating material removal station includes a mandrel for supporting and rotating the stator stack as excess coating material is removed from an outer circumferential surface of the stator stack and for displacing excess coating material from an inner circumferential surface of the stator stack.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
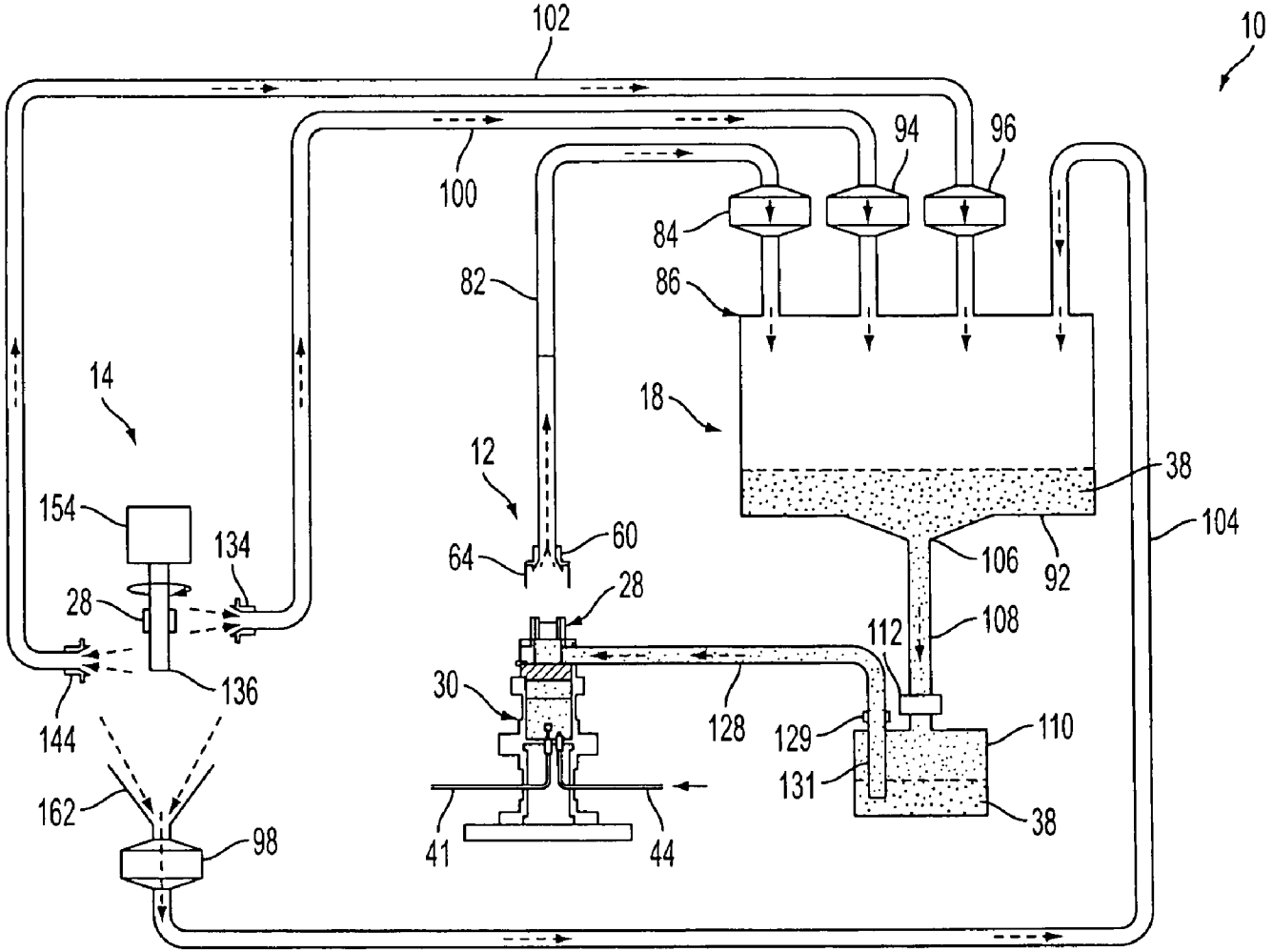
FIG. 1 is a diagrammatic view illustrating a system in accordance with the present invention.
Figure 2:
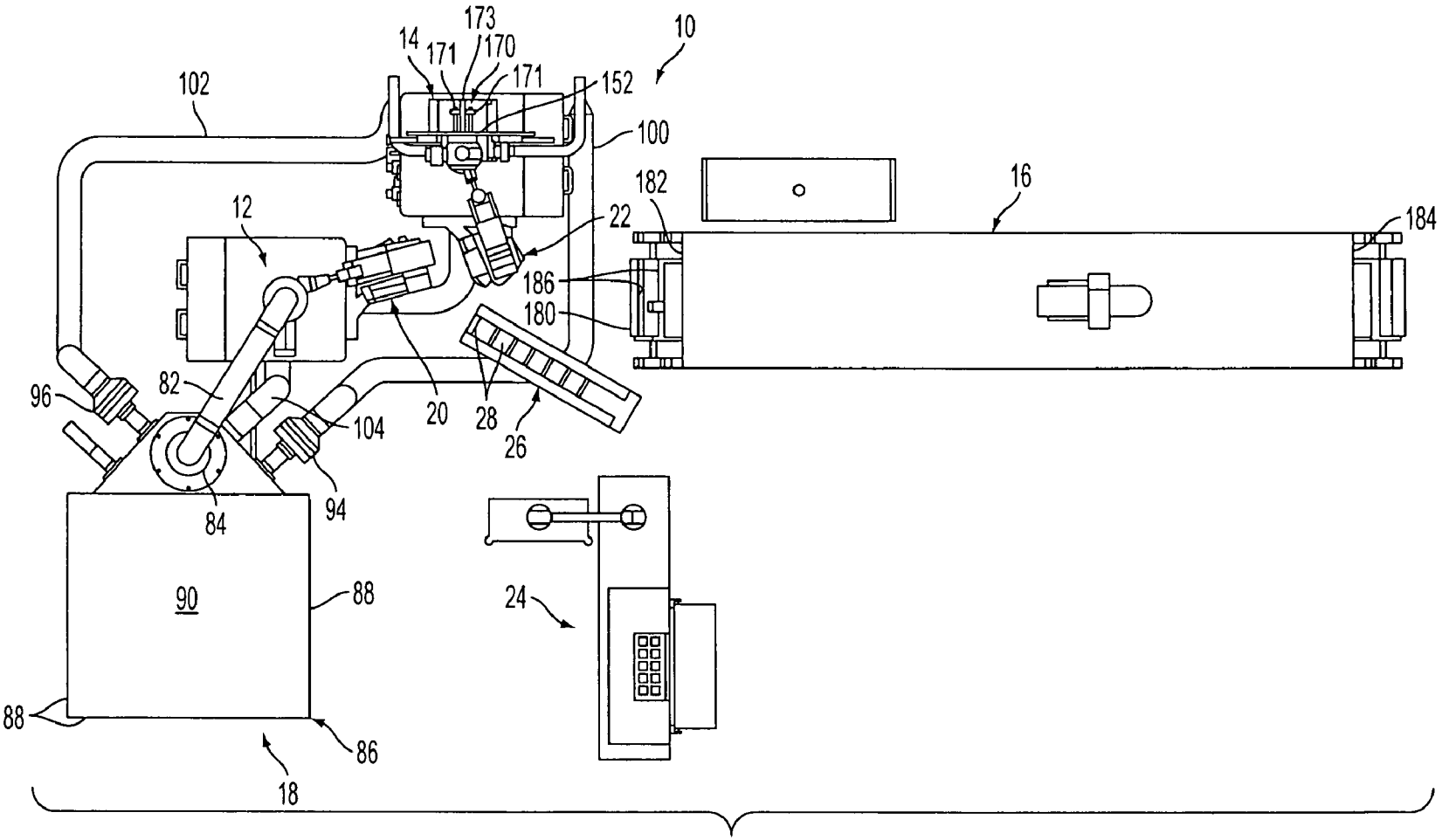
FIG. 2 is a top plan view of a system in accordance with the present invention.
Figure 3:
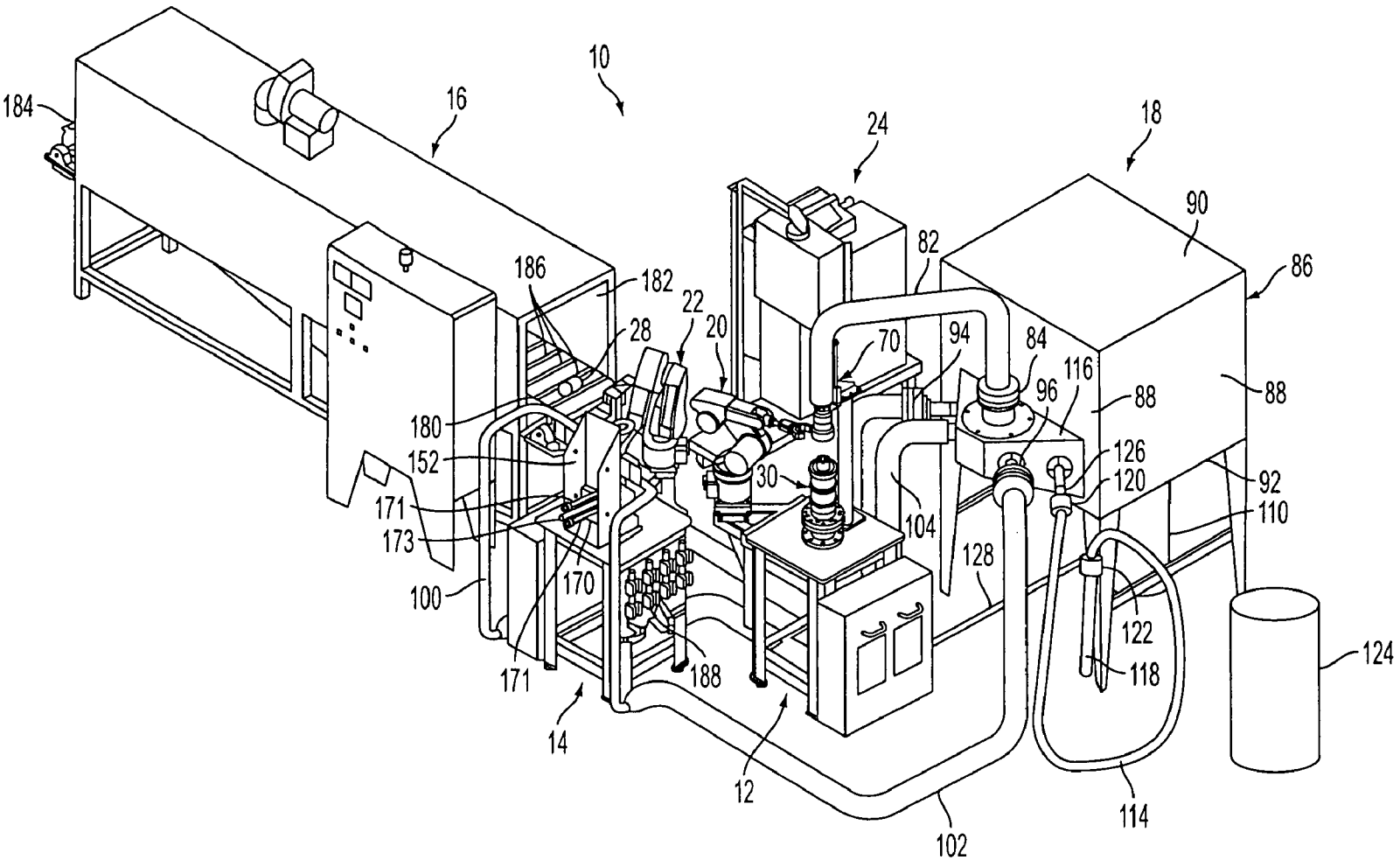
FIG. 3 is a perspective view of the system in accordance with the present invention.

Referring initially to FIGS. 1-3, the present invention may be implemented by a system 10 that generally comprises a powder coating station 12, a coating material removal station 14, a curing oven 16, a collection hopper 18, a first transfer member 20, a second transfer member 22, and a controller 24 for controlling the operations of the system 10, as is described below. In addition, a supply tray 26 (seen only in FIG. 2) or other supply mechanism may be provided for supplying a plurality of stator stacks 28 to be processed through the system 10.

Figure 4A:
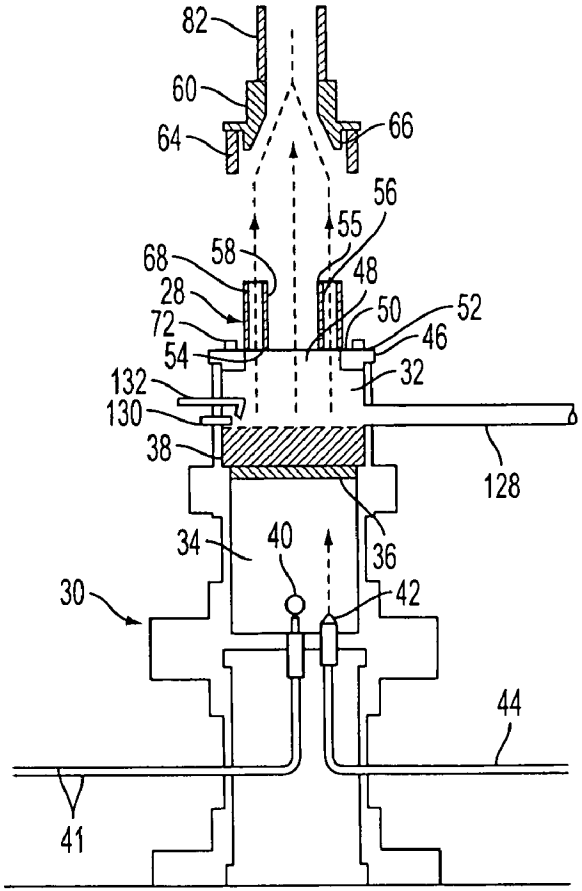
FIG. 4A is an enlarged diagrammatic view of a coating chamber assembly for the coating station.

Referring to FIGS. 1 and 4A, the coating station 12 comprises a coating chamber assembly 30 including a powder chamber 32 and an ionizing chamber 34 located below the powder chamber 32. A porous screen 36 separates the ionizing chamber 34 from the powder chamber 32 and forms the base for a powder bed comprising a layer of powder particles 38. The layer of powder particles 38 define a coating material for forming a coating layer on the stator stack 28 and preferably comprise an epoxy powder.

The ionizing chamber 34 includes an anode 40 that is connected to a high voltage DC power source (not shown) via power lines 41, and preferably provides a high negative voltage potential on the order of 70,000 to 90,000 volts to ionize air within the ionizing chamber 34. An outlet 42 from an air supply line 44 is also provided in the ionizing chamber 34 and is connected to an air source (not shown) for providing an upward air flow that passes through the porous screen 36. The upward air flow entrains the powder particles 38 to flow upwardly out of the powder chamber 32.

The top of the powder chamber 32 includes a plate 46 for supporting the stator stack 28 and providing a grounding connection during a coating operation. The plate 46 includes an aperture 48 for permitting passage of the powder particles 38 therethrough. The diameter of the aperture 48 is slightly smaller than the outer diameter of the stator stack 28, and a narrow groove 50 is defined in an upper surface 52 of the plate 46 extending radially outwardly from and circumferentially around the aperture 48. The groove 50 defines an outer diameter that is slightly greater than the outer diameter of the stator stack 28 and functions to position the stator stack 28 at a predetermined location on the plate 46. In addition, the groove 50 preferably covers a ring-shaped radially outer annular portion of the end surface of the stator stack 28 corresponding to an area that is not intended to be coated.

Air flow, with entrained powder particles 38 passing out of the powder chamber 32 though the aperture 48, will pass through the stator stack 28 to coat interior portions of the stator stack 28. In particular, exposed end surfaces 54, 55 and slot portions 56 of the stator stack 28 will preferably be coated by the powder particles 38 where, for a given orientation of the stator stack 28, the downwardly facing end surface 54 (as seen in FIG. 4A) will typically receive and retain a greater amount of the powder particles 38. As will be described further below, the stator stack 28 may be rotated end-for-end to provide a uniform application of the coating to the stator stack 28. In addition, an interior circumferential surface 58 of the stator stack 28 will become coated with the powder particles 38, although such coating of the interior circumferential surface 58 is not desirable for the present embodiment and requires subsequent removal, as is discussed further below.

Figure 4:
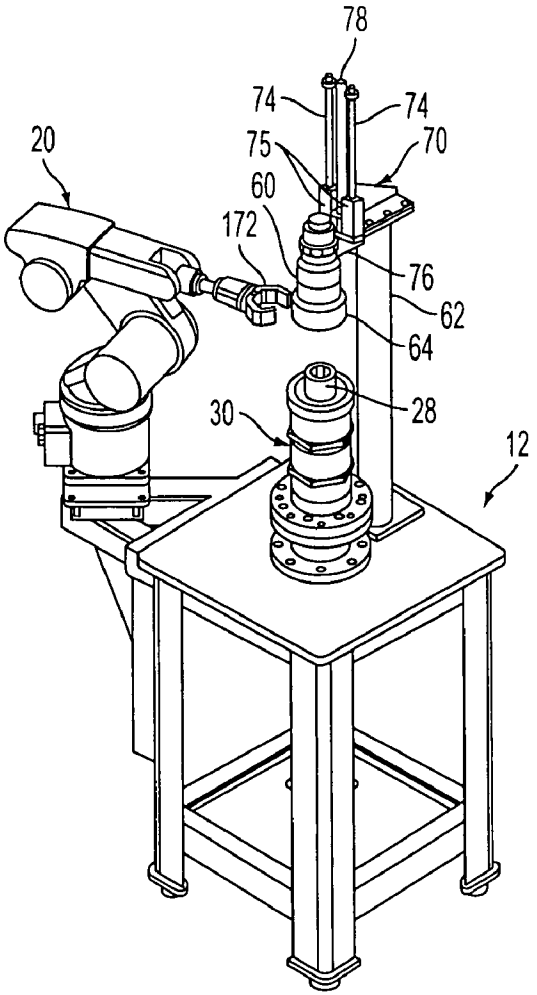
FIG. 4 is a perspective view of a powder coating station for the system.

Referring additionally to FIGS. 4 and 4A, a vacuum end 60 is supported on a mast member 62 above the coating chamber assembly 30. A cylindrical flow chamber member 64 surrounds and extends from an inlet end 66 of the vacuum end 60. The flow chamber member 64 has an interior circumferential dimension that may be greater than that of an outer circumferential surface 68 of the stator stack 28, and has a length that is at least as great as that of the stator stack 28. An actuator assembly 70 is located on the mast member 62 for actuating the vacuum end 60 and flow chamber member 64 to move vertically toward and away from the upper surface 52 of the plate 46. In a lowermost position for a powder fill operation performed prior to a stator stack 28 being placed on the plate 46, the flow chamber member 64 forms a seal with the plate 46 at a gasket 72 located on the plate 46 and surrounding the aperture 48. In an intermediate lowered position, the flow chamber member 64 is located just above a stator stack 28 on the plate 46 for a coating operation, as will be described in further detail below. The actuator assembly 70 comprises a pair of guide rods 74 guided through guide blocks 75 and connected to a support plate 76. The support plate 76 is attached adjacent an upper end of the vacuum end 60, and an air cylinder 78 is connected to the support plate 76 for providing the actuating force to effect vertical movement of the vacuum end 60 and flow chamber member 64 relative to the coating chamber assembly 30.

Referring to FIGS. 1, 2 and 3, a vacuum conduit 82 extends from the vacuum end 60 to an air conveyor 84. The air conveyor 84 operates to create a pressure differential within the vacuum conduit 82 to draw powder particles 38 from the coating chamber assembly 30 through the vacuum conduit 82 to the collection hopper 18. The air conveyor 84 may comprise an inductive fan, such as an inline exhaust fan available from Fantech of Sarasota, Fla.

The air conveyor 84 maintains an upstream low pressure area for drawing air into the vacuum end 60 and conveys excess powder particles 38 from a coating operation into the collection hopper 18. During a coating operation, the air flow rate into the vacuum end 60 is controlled in relation to the flow rate of air from the air outlet 42 of the air supply line 44 in order to control the flow of air and powder particles 38 passing through the stator stack 28 to a desired rate. For example, a constant flow rate of the air and powder particles 38 may be maintained during a coating operation. Alternatively, the flow rate through the stator stack 28 may be varied during the coating operation to provide a varying flow of particles 38 across the stator stack 28 and obtain a predetermined distribution of coating thickness, e.g., a uniform coating, on the surfaces of the stator stack 28. The flow rate through the stator stack 28 may be controlled by adjusting the flow rate through both the air outlet 42 and the vacuum end 60, where the flow rate through the flow amplifier 60 is preferably controlled to substantially correspond to the flow rate of the air outlet 42.

Referring to FIGS. 1, 2 and 3, the collection hopper 18 receives and stores a quantity of used or recycled powder particles 38, including the powder particles 38 received from the coating station 12. The collection hopper 18 is a substantially sealed unit, where powder particles 38 entering the collection hopper 18 are prevented from passing from the collection hopper 18 to the environment outside of the system 10. The collection hopper 18 comprises a rigid structural wall 86, illustrated herein as comprising a plurality of portions including a plurality of side walls 88, a top wall 90 and a bottom wall 92. Additional air conveyors 94, 96, 98 associated with respective vacuum conduits 100, 102, 104 are in fluid communication with the collection hopper 18 for conveying used or recycled powder particles 38 from the removal station 14 to the collection hopper 18. Operation of one or more of the air conveyors 84, 94, 96, 98 creates an air pressure within the collection hopper 18 that needs to be minimized or reduced in order to facilitate formation of a pressure differential within the vacuum conduits 82, 100, 102, 104 for efficient transfer of the powder particles 38 to the collection hopper 18. The rigid structural wall 86 comprises structural material defining interior and exterior surfaces of the collection hopper 18, and one or more portions of the rigid structural wall 86 comprise a non-fibrous microporous panel material, e.g., a resin material panel, that is permeable to air but that comprises pores substantially preventing passage of the powder particles 38 therethrough. A satisfactory material for the microporous panel material of the rigid structural wall 86 includes POREX® T3 sheet material POR-9948 having an average pore size of 10 microns, and available from Interstate Specialty Products of Sutton, Mass. It may be noted that a similar material may be used for the porous screen 36 separating the ionizing chamber 34 from the powder chamber 32 in the coating chamber assembly 30.

It should be understood that the collection hopper 18 is formed without a filter to relieve the air pressure within the hopper 18 and, in particular, a filter comprising fibrous filter material is avoided to eliminate the possibility of contamination of the recycled powder particles 38. The presence of a contaminant, such as fiber particles from a fiber filter, may result in a defect in the coating applied to the stator stacks 28. Hence, the present system 10 avoids a potential problem source noted in prior art powder recycling systems in that the sole air exit for passage of air from the collection hopper 18, other than through the powder passage ports to and/or from the hopper 18, is provided through the porous structural wall 86 of the hopper 18. Further, it should be understood that other materials than the one described above for the structural wall 86 may be incorporated to the extent that the sheet material is non-fibrous and permits passage of air therethrough while restricting passage of the powder particles 38.

Referring to FIGS. 1 and 3, material from the collection hopper 18 is transferred from an outlet 106 through an outlet conduit 108 to a distribution chamber 110 located below the collection hopper 18. Passage of the powder particles 38 to the distribution chamber 110 may be facilitated by an air amplifier 112 and may include a valve (not shown) to control flow of the powder particles 38 from the collection hopper 18.

Referring to FIG. 3, an auxiliary vacuum conduit 114 is connected to the collection hopper 18 at a port area 116 providing the attachment points for the air conveyors 84, 94 and 96 and for the vacuum conduit 104 from the air conveyor 98. The vacuum conduit 114 preferably includes an open wand end 118 and air amplifiers 120, 122 for creating a suction flow at the open wand end 118. The air amplifiers 120, 122 may be of the type that is well known in the art that typically uses the Coanda effect to increase a fluid flow through a nozzle, such as by using an input fluid flow, i.e., via a pressurized air flow line, to increase a suction fluid flow into the air amplifiers open wand end 118. An air amplifier operable for use in the present invention may be of the type available from EXAIR® Corporation of Cincinnati, Ohio. Further description of the operation of an air amplifier may be found, for example, in U.S. Pat. No. 5,402,938, which patent is incorporated herein by reference.

The wand end 118 is manually movable by an operator to selected locations to draw in powder particles 38 that are outside of the system 10. In particular, the wand end 118 may be inserted into a powder supply 124 for supplying fresh (unused) powder particles 38 to the system 10 at the port area 116. The fresh powder particles 38 may be introduced to the system 10 to replenish powder depleted from the coating process as well as to mix with the used powder particles 38 in order to maintain a minimum average powder particle size. A valve 126 is located in the auxiliary vacuum conduit 114 and remains closed, except during use of auxiliary vacuum conduit 114, to prevent powder particles 38 from exiting the collection hopper 18 through the auxiliary vacuum conduit 114 during operation of the other vacuum conduits.

Referring to FIGS. 1 and 4A, a powder supply conduit 128 extends from the distribution chamber 110 to the powder chamber 32 of the coating chamber assembly 30. The powder supply conduit 128 is connected to the outlet of an air amplifier 129 located at the top of the distribution chamber 110. A powder supply tube 131 extends from within the distribution chamber 110 to an inlet end of the air amplifier 129. The air amplifier 129 creates an air flow to convey powder particles 38 through the powder supply conduit 128 to the powder chamber 32 in response to a sensed low powder level in the powder chamber 32. In particular, the powder chamber 32 includes a powder level sensor 130 located at a preset level within the powder chamber 32 to detect when the layer of powder particles 38 falls below a preset or predetermined level, such as the level of the sensor 130. The sensor 130 may be any conventional sensor capable of sensing the presence or absence of a layer of powder particles 38. For example, in a preferred embodiment, the sensor 130 may comprise a capacitive proximity sensor, such as a Turck capacitive proximity sensor ID M2503099, available from TURCK Inc., of Minneapolis, Minn. When the sensor 130 senses that the layer of powder particles 38 is below the predetermined level, powder particles 38, including both fresh and recycled powder particles 38, may be conveyed from the distribution chamber 110 through the powder supply conduit 128 to the powder chamber 32. In addition, an air nozzle 132 is provided adjacent to the sensor 130 and includes an outlet opening directed to a sensing surface of the sensor 130. Prior to a sensing operation, a short burst of air is provided from the air nozzle 132 to clean the sensing surface of the sensor 130 to remove residual powder material coating the sensing surface and to facilitate obtaining an accurate measurement or detection of the level of powder particles 38 in the powder chamber 32.

Figure 5:
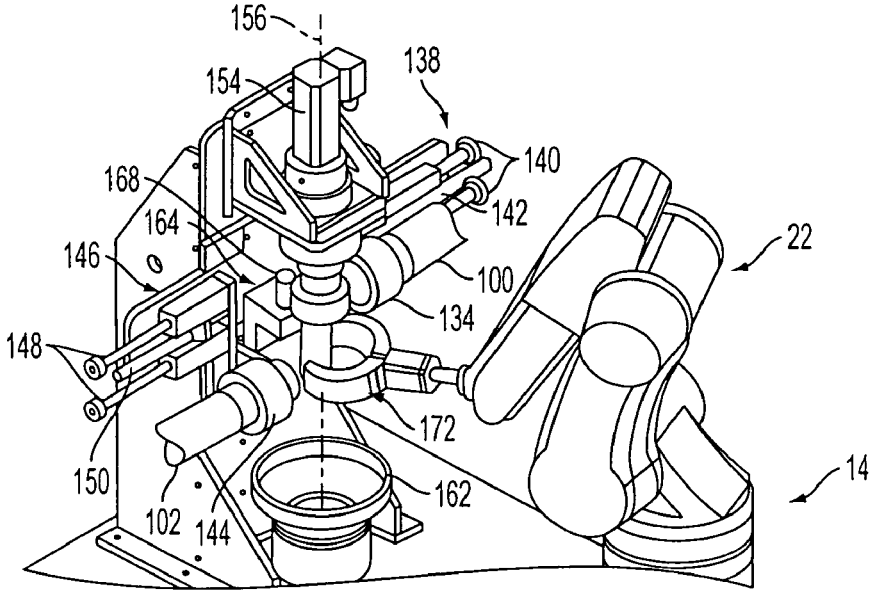
FIG. 5 is a perspective view illustrating a coating material removal station for the system operating to remove coating material from an exterior surface of a stator stack.
Figure 6:
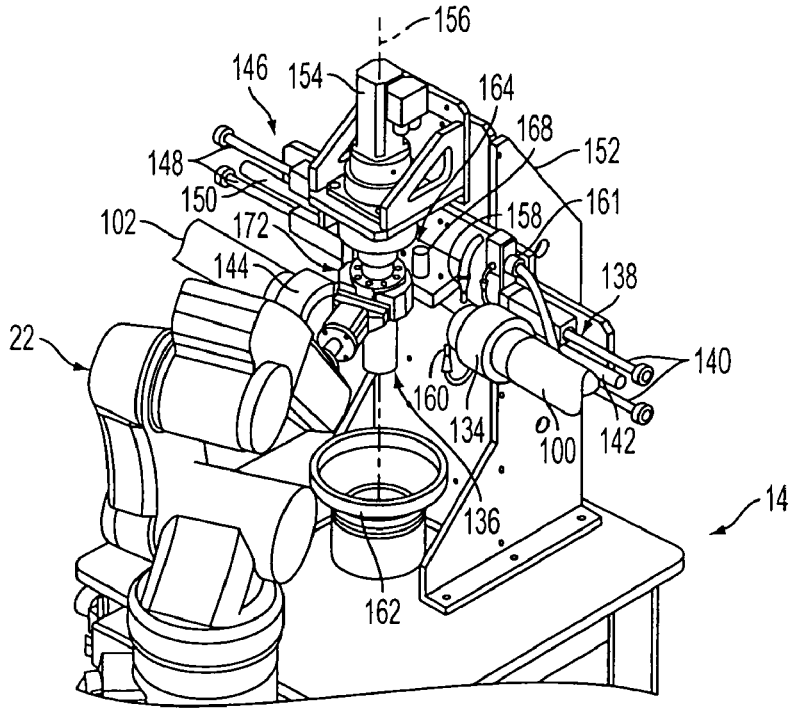
FIG. 6 is a perspective view illustrating the coating material removal station for the system operating to remove coating material from an interior surface of the stator stack.
Figure 7:
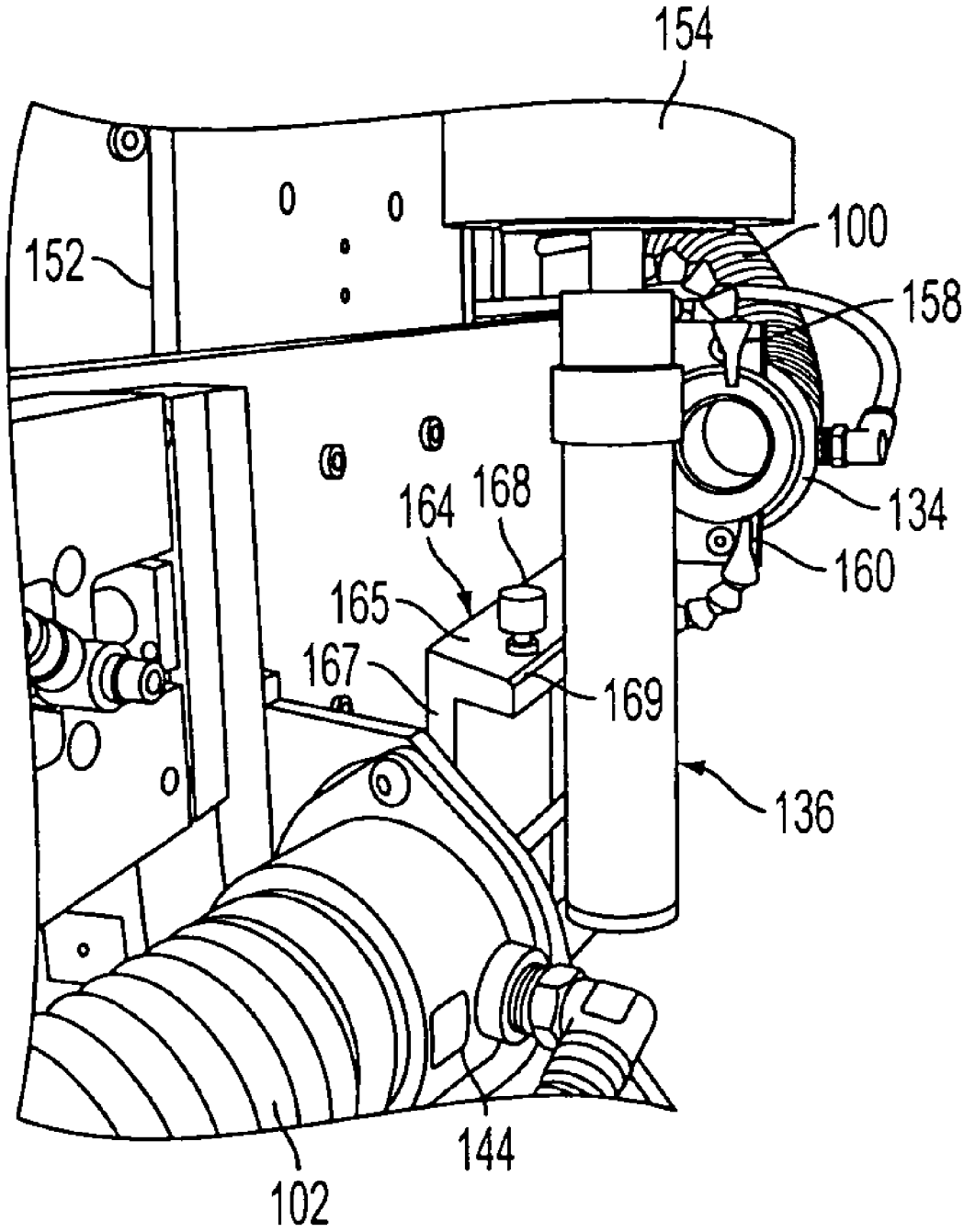
FIG. 7 is a perspective view showing an air amplifier for the coating material removal station including air nozzles for operating on end surfaces of stator stacks.
Figure 8:
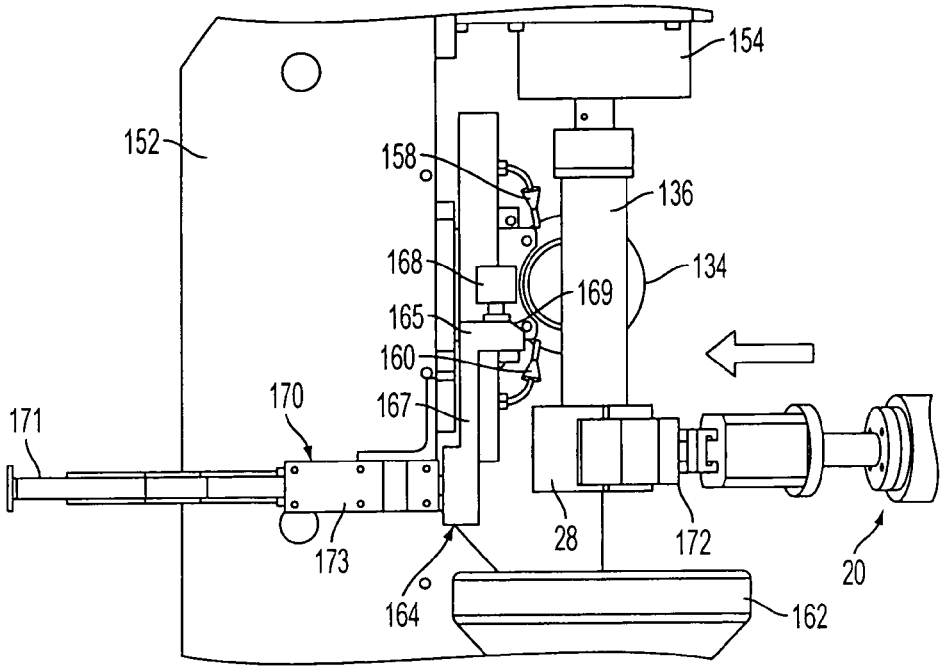
FIGS. 8-15 are diagrammatic views of the coating removal station illustrating the sequence of steps for displacing coating material from a stator stack.
Figure 9:
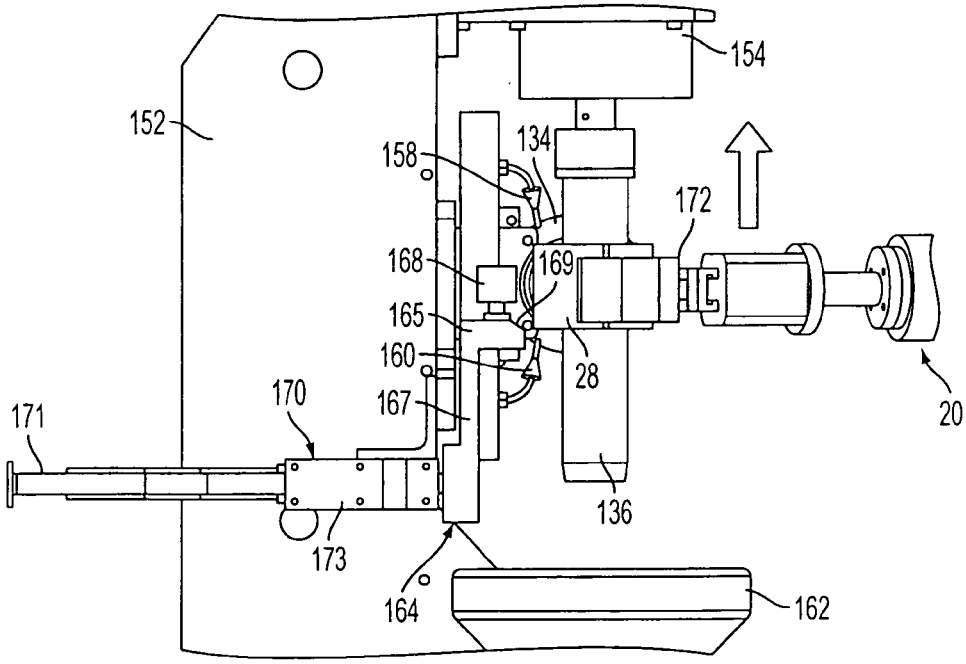
Figure 10:
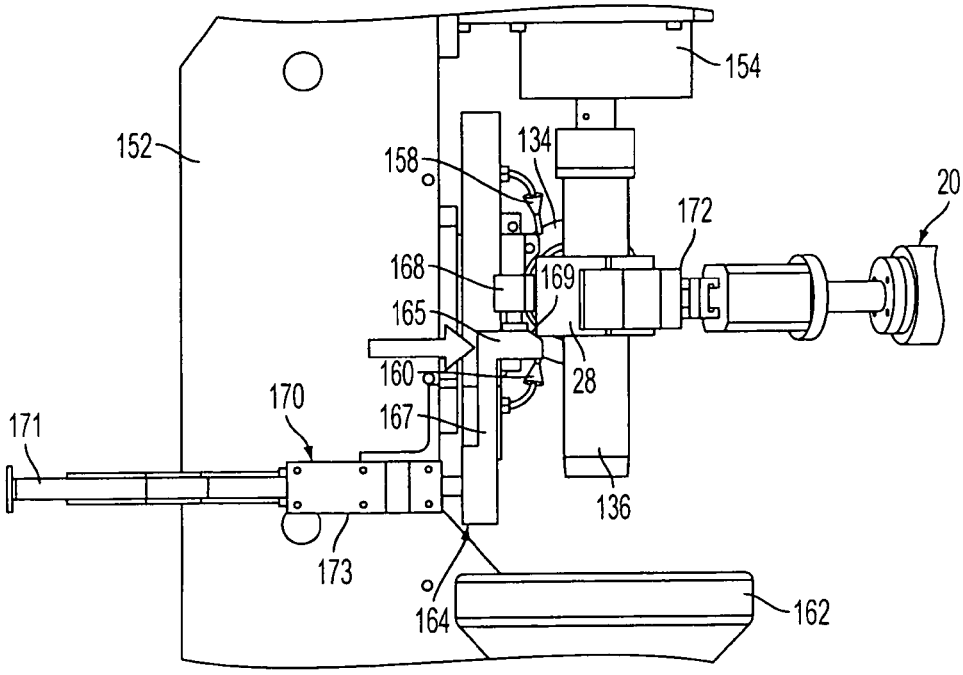

As noted above, the removal station 14 has a plurality of vacuum conduits associated with it, including the vacuum conduits 100, 102, 104, each of which has an inlet end located at the removal station 14. As seen in FIGS. 5, 6 and 7, the inlet end of the vacuum conduit 100 comprises an air amplifier 134 supported by an OD cleaner actuator assembly 138 including a pair of guide rods 140 and an air cylinder actuator 142 for effecting movement of the air amplifier 134 toward and away from a mandrel 136. The inlet end of the vacuum conduit 102 comprises an air amplifier 144 supported by a mandrel cleaner actuator assembly 146 including a pair of guide rods 148 and an air cylinder actuator 150 for effecting movement of the air amplifier 144 toward and away from the mandrel 136. The OD cleaner actuator assembly 138, mandrel cleaner actuator assembly 146, and mandrel 136 are supported on a removal station frame 152. In addition, the mandrel 136 is connected to a motor 154 for driving the mandrel 136 in rotational movement about a rotational axis 156. The motor 154 may comprise a brushless motor driving the mandrel 136 through a gearbox, or any other equivalent drive unit.

As seen in FIG. 7, a pair of suction nozzles 158, 160 are supported with the air amplifier 134 and are actuated in reciprocating movement toward and away from the mandrel 136 by the OD cleaner actuator assembly 138. The pair of suction nozzles 158, 160 each have an open inlet end, and each include an outlet end connected in fluid communication with the vacuum conduit 100 via a respective air amplifier 161 (only one shown in FIG. 6). The suction nozzles 158, 160 are preferably oriented substantially parallel to the rotational axis 156 of the mandrel 136. However, the suction nozzles 158, 160 may be positioned in any desired orientation to remove powder particles 38 from predetermined locations on the stator stacks 28. The air amplifier 134 is supported for movement to a location adjacent to a coated stator stack 28 located on the mandrel 136 to displace the powder particles 38 from the outer circumferential surface 68 of the stator stack, and the suction nozzles 158, 160 are positioned relative to the air amplifier 134 to displace powder particles 38 from a radially outer annular area on either end surface 54, 55 of the stator stack 28 while leaving the powder particle coating on radially inner portions of the coated ends 54, 55 undisplaced or undisturbed.

Referring to FIGS. 1, 5 and 6, a coating material collection funnel 162 is located below the mandrel 136, and has a sufficiently wide opening for collecting powder particles 38 displaced from a coated stator stack 28 located in the removal station 14. The funnel 162 is located above the air conveyor 98 connected to the vacuum conduit 104. The air conveyor 98 creates a flow of air for drawing in displaced powder particles 38 falling from the location of the mandrel 136 and for conveying the displaced powder particles 38 to the collection hopper 18.

Referring further to FIG. 7, the mandrel 136 comprises a substantially rigid cylinder, e.g., an aluminum cylinder, and includes a resilient outer cover for engaging the inner circumferential surface 58 of the stator stack 28. For example, the mandrel 136 may comprise an aluminum cylinder preferably dip coated with latex to form the outer cover. Alternatively, other outer cover materials may be provided such as a silicon rubber material. Latex is preferred for the outer cover in that latex is effective for wiping powder particles 38 from the inner circumferential surface 58 of the stator stack 28, while also providing a surface from which the powder particles 38 may be readily removed, i.e., a surface that readily releases the powder particles 38. As described further below with reference to a powder removal operation, the mandrel 136 is capable of rotating within a stator stack 28 held stationary relative to the mandrel 136 in order to displace powder particles 38 from the inner circumferential surface 58.

The coating removal station 14 further includes a stack support member 164, illustrated herein as an L-shaped member having a horizontal portion 165 and a vertical portion 167. A pressure roller 168 is rotatably supported on the horizontal portion 165 for engaging the outer circumferential surface 68, and a ramped edge 169 (see also FIGS. 9-15) is formed at a forward face of the horizontal portion 165 for engaging a stator stack 28 at an edge location between the outer circumferential surface 68 and the lower end surface 54. A support plate actuator assembly 170 is also provided (see FIGS. 2 and 3), supported on the removal station frame 152, and including a pair of guide rods 171 and an air cylinder actuator 173 for effecting movement of the stack support member 164 and pressure roller 168 toward and away from a stator stack 28 on the mandrel 136.

As noted above, the system 10 includes first and second transfer members 20, 22, which are operated to transfer the stator stacks 28 between the different stations and to manipulate the stator stacks 28 for operations performed within the stations of the system 10. The transfer members 20, 22 are substantially similar robot devices and, in the illustrated embodiment, comprise a Denso model VS-6556E six-axis robot, available from DENSO Robotics of Long Beach, Calif. Each of the robots comprising the transfer members 20, 22 includes an articulated gripper member 172 comprising opposing jaw halves that may be actuated to move toward and away from each other to grip a stator stack 28 therein. The gripper member 172 may comprise a two-jaw gripper model P-3100 available from RAD, a division of Process Equipment Corporation of Tipp City, Ohio.

The first transfer member 20 is provided for transferring stator stacks 28 from the supply tray 26 to the coating chamber assembly 30 at the coating station 12, for manipulating the stator stacks 28 at the coating station 12, and for transferring coated stator stacks 28 to the coating removal station 14. The second transfer member 22 is provided for manipulating the coated stator stacks 28 at the coating removal station 14, and for transferring the coated stator stacks 28 from the coating removal station 14 to the oven 16.

Referring to FIGS. 2 and 8-16, a process for applying solid particulate powder coating material to stator stack 28 utilizing the above-described system comprises providing a series or plurality of uncoated stator stacks 28 on the supply tray 26, and comprises a step of initially sensing the level of powder particles 38 located in the powder chamber 32. A sensor cleaning operation is preferably performed prior to any sensor reading operation, and comprises a short air blast from the air nozzle 132 to clean the sensing surface of the sensor 130. A reading is obtained from the sensor 130, providing a determination as to whether the powder particles 38 are up to the preset level in the powder chamber 32 corresponding to the location of the sensor 130. If insufficient powder particles 38 are present, the actuator assembly 70 moves the flow chamber 64 downwardly to engagement with the gasket 72 on the plate 46 and a fill operation is performed, such as for a predetermined fill time, to transfer powder particles from the distribution chamber 110 into the powder chamber 32 through the powder supply conduit 128.

When the powder 38 is conveyed to the powder chamber 32, a cloud of powder is created within the powder chamber 32 in that the powder flow is very turbulent. Further, as a result of the powder particles 38 entering the powder chamber 32 from the side through the supply conduit 128 as a powder cloud, the incoming powder does not fill up very smoothly within the powder chamber 32, and the reading provided by the sensor 130 may incorrectly indicate that the powder chamber 32 is filled to the required level. That is, portions of the chamber 32 that are not adjacent to the sensor 130 may still have a low level of powder particles 38 when the sensor 130 indicates that the powder chamber 32 is filled to the predetermined level. Accordingly, a leveling operation is performed following the fill operation wherein an air flow through the air flow outlet 42 is turned on for a very short time period, such as 0.5 seconds, to provide a short burst of air to substantially even out the distribution of the powder particles 38 and provide a more level upper surface of the powder particles 38. Following the leveling operation, the sensor 130 is cleaned with air from the air nozzle 132, and a further reading is obtained from the sensor 130. The fill process may be repeated until the predetermined level is sensed at the sensor 130.

When the predetermined level of powder particles 38 is present in the powder chamber 32, the actuator assembly 70 moves the flow chamber 64 upwardly away from the plate 46 and the first transfer member 20 picks up one of the stator stacks 28 from the supply tray 26 and places it in the groove 50 over the aperture 48 in the plate 46 of the coating chamber assembly 30. The gripper member 172 of the first transfer member 20 releases from the stator stack, and the actuator assembly 70 moves the flow chamber member 64 down to the intermediate lowered position adjacent to the upper end 55 of the stator stack 28 to draw in powder particles 38 passing through the stator stack 28, see FIG. 4A.

The coating operation is performed by air from the air flow outlet 42 and suction from the vacuum end 60 and vacuum conduit 82 creating a fluidized bed of powder particles 38 flowing upwardly through the stator stack 28 to form a powder coating on the stator stack 28. Following flow of the powder particles 38 through the stator 28, the actuator assembly 70 may move the flow chamber member 64 away from the stator stack 28 and the first transfer member 20 may pick up the stator stack 28, rotate it end-for-end, i.e., rotate it 180°, and replace it on the plate 46. The actuator assembly 70 may again move the flow chamber member 64 to the intermediate lowered position, and a further flow of powder particles 38 through the stator stack 28 may be provided to produce a uniform coating of the powder particles 38 on the stator stack 28.

The flow through one or both of the air flow outlet 42 and the vacuum end 60 may be controlled, including varying of the flow rate, during the coating process to control distribution of the powder particles 38. The coating applied to the stator stack 28 preferably comprises a uniform powder particle coating in the slot portions 56 and to the ends 54, 55. However, additional, undesirable coating is also typically formed on the interior circumferential surface 58 and on the outer circumferential surface 68.

Referring to FIGS. 8-15, at the conclusion of the coating step performed at the coating station 12, the first transfer member 20 picks up the coated stator stack 28 and moves it to the coating removal station 14. The first transfer member 20 moves the coated stator stack 28 upwardly onto the mandrel 136, such that the resilient outer cover of the mandrel 136 is located for contact with the interior circumferential surface 58, see FIGS. 8 and 9. The mandrel 136 is preferably rotated during the upward movement of the stator stack to the position shown in FIG. 9.

Figure 11:
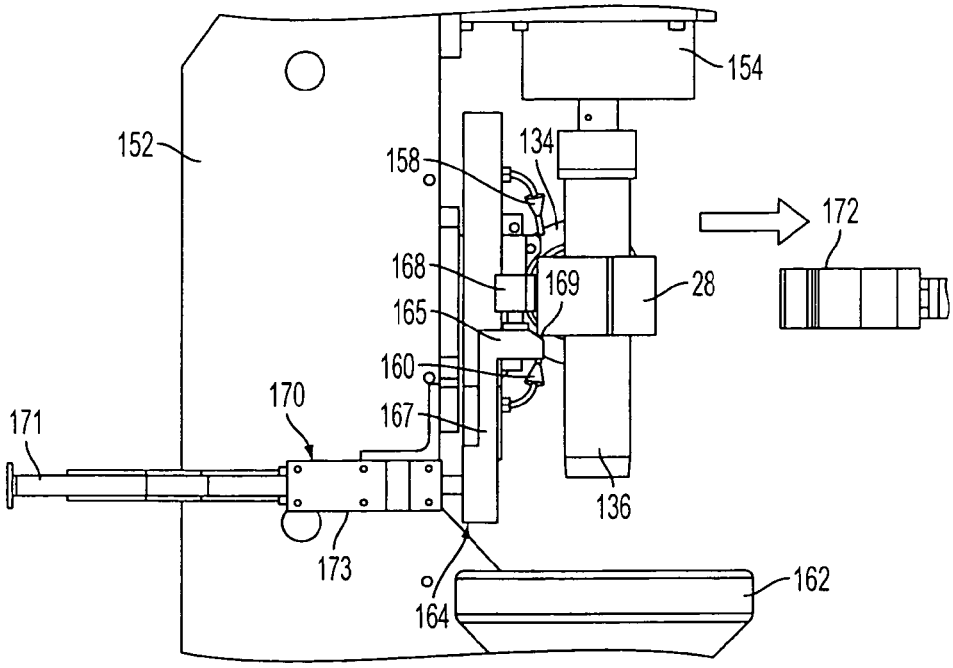

The air cylinder 173 is actuated to effect movement of the support member 164 toward the mandrel 136 to engage the ramped edge 169 of the horizontal portion 165 with the lower edge of the stator stack 28, providing support for maintaining the stator stack 28 at a desired vertical position on the mandrel 136 (FIG. 10) when the gripper 172 of the robot 20 retracts (FIG. 11). In addition, the pressure roller 168 is moved into pressure engagement with the outer circumferential surface 68 of the stator stack 28 during actuation of the support member 164. The pressure roller 168 causes the inner circumferential surface 58 of the stator stack 28 to frictionally engage with the outer cover of the mandrel 136, such that the stator stack 28 rotates with rotation of the mandrel 136 while being maintained at the desired vertical position by the ramped edge 169. The pressure roller 168 may be spring biased in the direction of the mandrel 136 to maintain a desired pressure and accommodate variations in the wall thickness of the stator stack 28.

Figure 12:
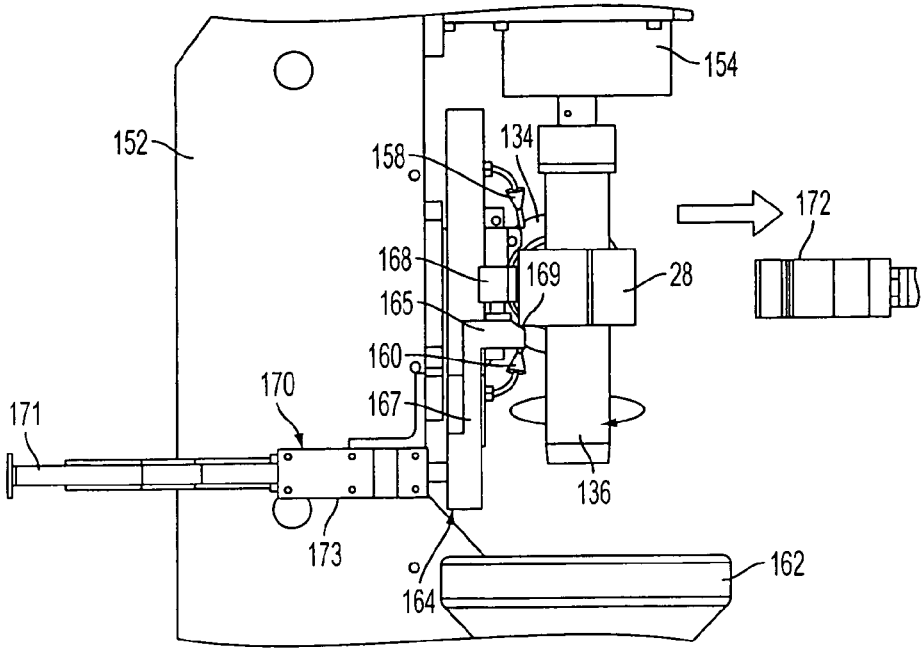

As illustrated in FIG. 12, the stator stack 28 is retained in substantial vertical alignment with the air amplifier 134, and movement of the air amplifier 134 and associated suction nozzles 158, 160 toward the stator stack 28 is effected by the actuator assembly 138. During an OD cleaning operation, a vacuum is applied through the air amplifier 134 to displace powder particles 38 from the outer circumferential surface 68 of the stator stack 28, and the suction nozzles 158, 160 apply a suction force at the outer annular edges of the end surfaces 154, 155 while the stator stack 28 is rotated by the mandrel 136. The uncoated outer annular edges of the end surfaces 154, 155 define uncoated registration surfaces for use, for example, in mounting of an assembled stator (not shown) incorporating the stator stack 28 in a motor housing (not shown).

Figure 13:
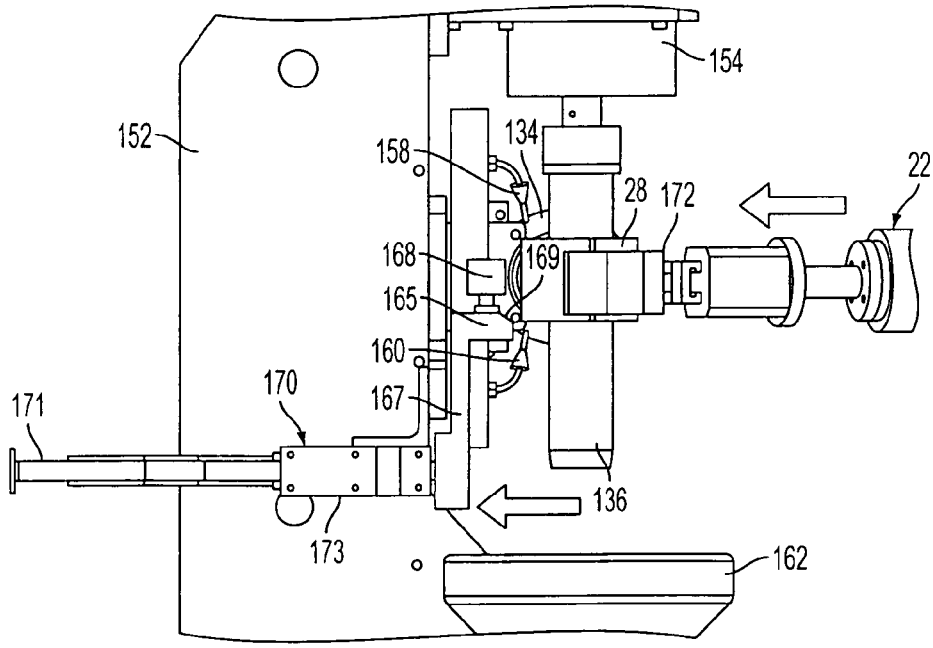
Figure 14:
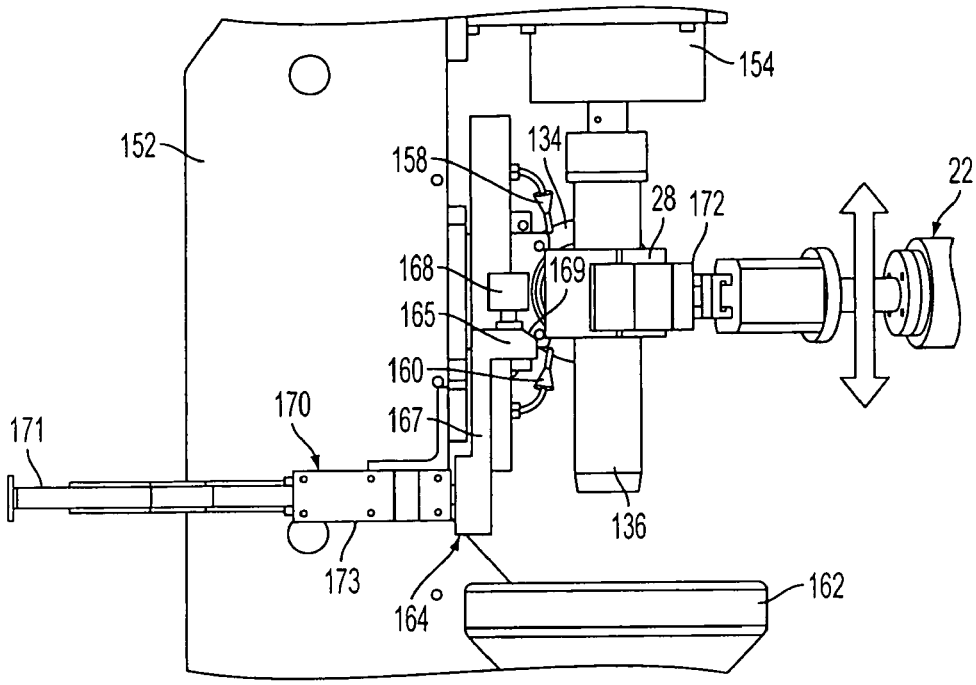
Figure 15:
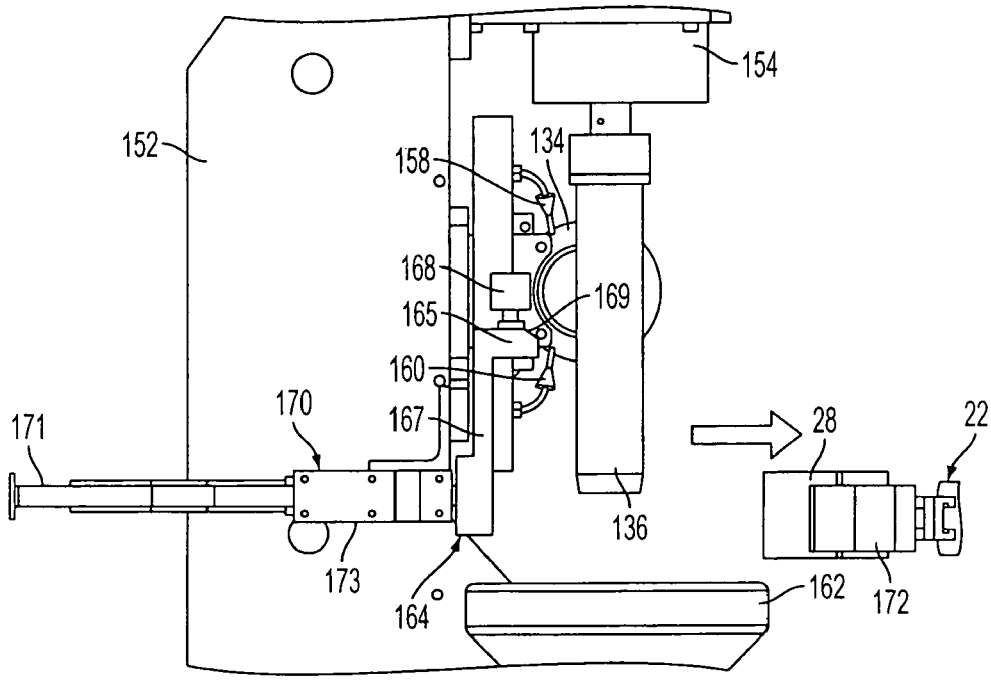
Figure 16:
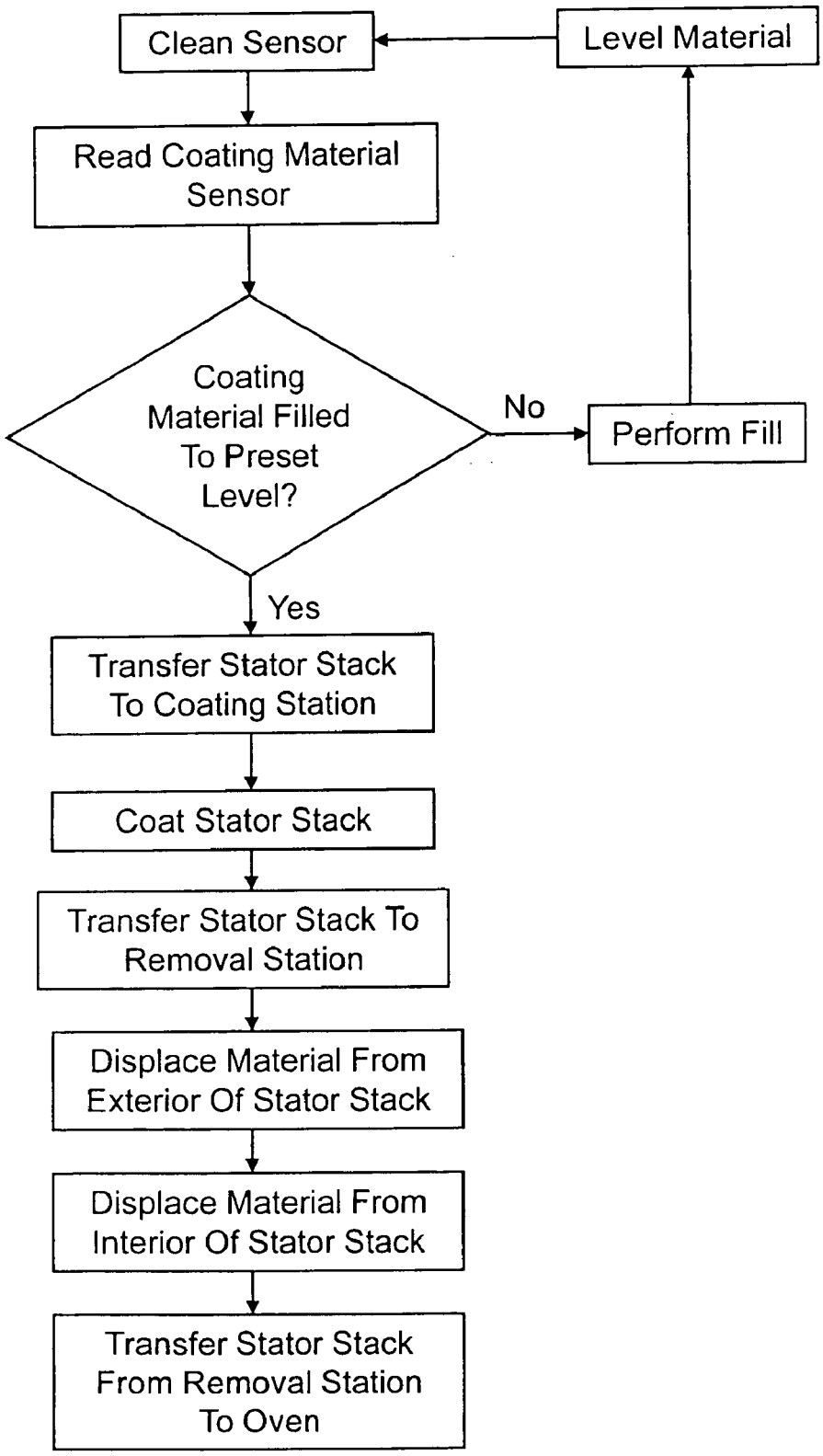
FIG. 16 is flow diagram illustrating a process for applying coating material to stator stacks.

Subsequently, an ID cleaning operation is performed as is illustrated in FIG. 13. During the ID cleaning operation, the gripper member 172 of the second transfer member 22 grips the stator stack 28 and holds it from rotating relative to the mandrel 136, and the support member 164 is retracted away engagement with the stator stack 28. The mandrel 136 is rotated to rub the outer cover of the mandrel across the interior circumferential surface 58 of the stator stack 28 to displace the powder particles 38 from the interior circumferential surface 58. During rotation of the mandrel 136, the second transfer member 22 may move the stator stack 28 vertically in a reciprocating movement along the mandrel 136 to further facilitate removal of the powder particles 38, as is illustrated in FIG. 14. The ID cleaning operation may further comprise the second transfer member 22 moving the stator stack 28 downwardly off the mandrel 136, the actuator assembly 146 effecting movement of the air amplifier 144 moving to the mandrel 136 to provide a vacuum for displacing powder particles 38 from the mandrel 136 as the mandrel 136 rotates, the air amplifier 144 moving back away from the mandrel 136, and the second transfer member 22 again moving the stator stack 28 onto the mandrel 136 to further displace powder particles 38 from the interior circumferential surface 58.

The air conveyor 98 is activated during the OD and ID cleaning operations described above. The collection funnel 162 facilitates collecting and directing the displaced powder particles 38 to the inlet of the vacuum conduit 104, and the air conveyor 98 provides an air flow for conveying the powder particles 38 to the collection hopper 18.

Following the OD and ID cleaning operations, the second transfer member 22 transfers the coated stator stack 28 to the curing oven 16 where the powder particles 38 are cured to adhere to the stator stack 28. As may be seen in FIGS. 2 and 3, the curing oven 16 may include a conveyor 180 for conveying coated stator stacks 28 from an entrance end 182 to an exit end 184 of the curing oven 16. The conveyor 180 preferably includes pairs of slat members 186 supported vertically on the conveyor 180, where each pair of slat members 186 is spaced a distance less than the outer diameter of the stator stacks 28. Each pair of slat members 186 may support a stator stack 28 in the space between the upper edges of the slat members 186, to pass through the oven 16 on the conveyor 180. The curing oven 16 includes heating elements, such as infrared heating elements, to heat and melt the powder particles 38 attached to the stator stacks 28 to form an insulating coating over the ends 54, 55 and through the slot portions 56 of the stator stacks 28 in preparation for a stator winding operation comprising winding stator wires through the stator slots 56.

Referring to FIG. 3, the air supplied to the air amplifiers 60, 120, 122, 134 and 144, 158, 160, as well as to the air supply line 44 and the air nozzle 132 may be provided through a set of valves 188 under control of the controller 24. Also, the set of valves 188 may provide control of air to actuate the air cylinders 78, 142, 150, 173 and any other air actuated devices in the system 10.

It should be noted that the controller 24 may be programmed to change control of the system 10 to maximize the coating of the stator stacks 28 and/or to accommodate different characteristics of the different stator stacks 28 that may be coated by the system 10. For example, the voltage applied to the anode 40 to ionize the powder particles 38 may be changed and the velocity of the air flow from the air outlet 42, and through the vacuum end 60, may be adjusted depending on the particular physical characteristics of the stator stacks 28 being coated. The controller 24 may store predetermined values to be used for performing coating operations on different stator stacks 28, or to obtain predetermined coating characteristics on the stator stacks 28.

From the above description, it may be seen that the described system and process for coating stator stacks is configured to provide a controlled uniform coating to selected areas of the stator stacks, including an efficient operation for displacing powder particles from selected portions of the stator stacks. In addition, the described system and process substantially limits contamination of the environment with powder particles during the coating process and recycling of powder particles, such as by applying only vacuum or suction to displace powder particles from specified areas of a coated stator stack. Further, the system for containing and collecting the recycled powder particles substantially limits contamination of recycled powder.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of applying a solid particulate powder coating to a stator stack having a plurality of longitudinally extending stator slots, the method comprising the steps of:

depositing particulate powder coating material on the stator stack;

positioning the stator stack over a mandrel;

rotating the mandrel and stator stack together about a common axis while displacing the coating material from an outer circumferential surface of the stator stack; and holding the stator stack stationary relative to the mandrel while rotating the mandrel relative to the stator stack to displace the coating material from around an inner circumferential surface of the stator stack.

2. The method of claim 1, including the step of displacing the coating material from a radially outer annular area of an end surface of the stator stack, while leaving a radially inner portion of the coating material on the end surface of the stator stack undisplaced, during the step of rotating the mandrel and stator stack together.

3. The method of claim 1, wherein the step of displacing the coating material from the outer circumferential surface comprises applying a vacuum adjacent to the outer circumferential surface.

4. The method of claim 1, wherein the mandrel comprises a resilient contact surface for engaging the inner circumferential surface of the stator stack.

5. The method of claim 4, further including moving a support member in a direction transverse to a rotational axis of the mandrel to engage and support the stator stack at a desired vertical position on the mandrel.

6. The method of claim 4, wherein the step of displacing the coating material from the inner circumferential surface of the stator stack comprises gripping the outer circumferential surface and wiping the inner circumferential surface with the resilient contact surface.

7. The method of claim 6, wherein the step of displacing the coating material from the inner circumferential surface further comprises reciprocating the stator stack during the step of wiping the inner circumferential surface with the resilient contact members.

8. The method of claim 1, wherein the step of depositing the coating material comprises the steps of:

a) positioning a flow chamber on a coating chamber assembly and filling a powder chamber within the coating chamber assembly with the coating material;

b) separating the flow chamber from the coating chamber assembly;

c) placing a stator stack on the coating chamber assembly; and d) creating a flow of the coating material from the powder chamber, through the stator stack and into the flow chamber at a location above the stator stack.

9. The method of claim 1, wherein the step of depositing the coating material comprises initiating a coating process by performing the following ordered steps:

a) performing a first sensing operation sensing a level of coating material in a powder chamber;

b) upon sensing a predetermined level of the coating material is not present in the powder chamber, providing a flow of additional coating material to the powder chamber;

c) providing a flow of air through the coating material in the powder chamber;

d) performing a second sensing operation sensing a level of coating material in the powder chamber; and e) upon sensing the predetermined level of coating material during the second sensing operation, placing a stator stack in association with the powder chamber and starting a flow of the coating material toward the stator stack from the powder chamber to provide the coating to the stator stack.

10. The method of claim 9, further including, prior to each of steps a) and d), performing a sensor cleaning operation to remove coating material from a surface of the sensor.

11. The method of claim 1, wherein the step of holding the stator stack stationary relative to the mandrel while rotating the mandrel relative to the stator stack includes rotating the mandrel about a vertical axis while holding the stator stack stationary.

12. The method of claim 1, including:

a supply of stator stacks and a first transfer member transferring a stator stack from the supply of stator stacks to a coating station for performing the depositing of coating material on the stator stack;

the first transfer member transferring the stator stack from the coating station to the mandrel; and a second transfer member transferring the stator stack from the mandrel to a further station for curing the coated stator stack.

13. The method of claim 12, wherein the first and second transfer members each comprise a gripper member, and the gripper members grip the outer circumferential surface of the stator stack for transferring the stator stack.

14. A method of applying a solid particulate powder coating to a stator stack having a plurality of longitudinally extending stator slots, the method comprising the steps of:

depositing particulate powder coating material on the stator stack;

positioning the stator stack over a mandrel;

moving a support member in a direction transverse to a rotational axis of the mandrel to engage and support the stator stack at a desired vertical position on the mandrel;

rotating the mandrel and stator stack while displacing the coating material from an outer circumferential surface of the stator stack; and holding the stator stack while rotating the mandrel relative to the stator stack to displace the coating material from an inner circumferential surface of the stator stack.

15. The method of claim 14, wherein the support member engages the stator stack adjacent a lower end surface of the stator stack to support the stator stack.

16. A method of applying a solid particulate powder coating to a stator stack having a plurality of longitudinally extending stator slots, the method comprising the steps of:

depositing particulate powder coating material on the stator stack, including depositing coating material on an outer circumferential surface of the stator stack;

positioning the stator stack over a mandrel;

positioning a vacuum source adjacent to the outer circumferential surface of the stator stack;

rotating the mandrel and stator stack while actuating the vacuum source to draw off and substantially clean the coating material from the outer circumferential surface of the stator stack.

17. The method of claim 16, wherein the vacuum source comprises an air amplifier, and including the step of supplying air to the air amplifier.

18. The method of claim 16, including:

positioning a suction source adjacent an end surface of the stator stack, adjacent an outer circumferential edge of the end surface; and actuating the suction source to remove the coating material from the outer circumferential edge of the end surface, while leaving a radially inner portion of the coating material on the end surface of the stator stack undisplaced, during rotation of the mandrel and stator stack.

* * * * *